US007062053B2

(12) United States Patent
Hohjyo

(10) Patent No.: US 7,062,053 B2
(45) Date of Patent: Jun. 13, 2006

(54) CONDENSER MICROPHONE STRUCTURE

(75) Inventor: Masayoshi Hohjyo, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 100 days.

(21) Appl. No.: 10/447,704

(22) Filed: May 29, 2003

(65) Prior Publication Data

US 2003/0223611 A1 Dec. 4, 2003

(30) Foreign Application Priority Data

May 31, 2002 (JP) ..... 2002-159109

(51) Int. Cl.
*H04R 25/00* (2006.01)

(52) U.S. Cl. ..... 381/174; 381/355; 381/361

(58) Field of Classification Search ..... 381/355–369, 381/87, 91, 122, 174–175, 191
See application file for complete search history.

(56) References Cited

U.S. PATENT DOCUMENTS 5,823,820 A * 10/1998 Patel et al. ..... 439/500
5,889,873 A * 3/1999 Sasaki ..... 381/190
6,018,584 A * 1/2000 Paulick ..... 381/122
6,128,385 A * 10/2000 Goyal et al. ..... 379/433.01
6,748,091 B1 * 6/2004 Hohjyo et al. ..... 381/174

* cited by examiner

*Primary Examiner*—Sinh Tran
*Assistant Examiner*—Phylesha L Dabney
(74) *Attorney, Agent, or Firm*—Pearne & Gordon LLP

(57) ABSTRACT

Herein disclosed is a condenser microphone structure which comprises a microphone housing, a condenser microphone accommodated in the microphone housing to produce a sound signal indicative of a voice sound, first and second terminal connecters provided on the microphone housing in the neighborhood of each other under an insulated state from each other, each of the first and second terminal connecters including a helical spring portion, and an end portion integrally formed with the helical spring portion, the helical spring portion and the end portion being made of an electrically conductive material, the end portions being electrically connected with the condenser microphone to discharge the sound signal from the condenser microphone through the first and second terminal connecters, and an insulating member accommodated in the microphone housing to retain the condenser microphone and the first and second terminal connecters with the microphone housing and to insulate the first terminal connecter from the second terminal connecter. The condenser microphone thus constructed can cause high frequency noises to be reduced to as a small level as possible, and can be produced at a relatively low production price and at a considerably short production period.

8 Claims, 11 Drawing Sheets

CONDENSER MICROPHONE STRUCTURE

BACKGROUND OF THE INVENTION

1. Field of the Invention

The present invention relates to a condenser microphone structure, and more particularly to a condenser microphone structure to be assembled in a cellular phone with high frequency noises reduced to as a small level as possible.

2. Description of the Related Art

As such a conventional condenser microphone structure assembled in a cellular phone to enable communications with other cellular phones, there has so far been proposed and developed a wide variety of condenser microphone structures which are known as being small in size and as having one or more terminal connecters electrically connected with parts or elements forming part of the cellular phone.

One of the typical examples of the condenser microphone structures thus known is shown in FIGS. 10 and 11 as comprising a housing 51, a condenser microphone 52 accommodated in the housing 51, an insulator 53 made of a synthetic resin material and also accommodated in the housing 51, and a pair of terminal connecters 54 and 55 securely mounted on the insulator 53. In FIGS. 10 and 11, illustrated is part of a cellular phone 50 which comprises a printed circuit board 56 and a pair of board terminals 57 and 58 securely mounted on the printed circuit board 56 to be electrically connected with elements or parts constituting the cellular phone 50. Each of the terminal connecters 54 and 55 has two projected portions one of which is projected into engagement with the condenser microphone 52 and the other of which is projected into engagement with the board terminals 57 and 58 of the printed circuit board 56. The insulator 53 and the terminal connecters 54 and 55 are integrally coupled with each other and received in the housing 51 in such a way that the terminal connecters 54 and 55 are held in resilient and firm engagement with the condenser microphone 52 and the board terminals 57 and 58 of the printed circuit board 56 to ensure electric connection between the condenser microphone 52 and the printed circuit board 56.

Each of the terminal connecters 54 and 55 is made of a metal plate material having a resilient characteristic and is produced through the steps of firstly punching a metal plate material and secondly bending the punched metal plate material to have respective free end portions bent as will seen from FIGS. 10 and 11.

The conventional condenser microphone structure thus constructed is operated to generate a sound signal with the condenser microphone serving to transform a voice sound into the sound signal when receiving the voice sound from the exterior of the cellular phone.

The conventional condenser microphone structure, however, encounters such problems that the condenser microphone tends to receive high frequency noises through the terminal connecters other than voice sounds, resulting from the fact that the terminal connecters each made of a metal plate material has a relatively large surface area. In addition, the conventional condenser microphone structure is produced through the steps of punching a sheet metal, and bending the punched sheet metal by a metal mold high in precision to produce a terminal connecter in the form of a plate having a uniformed shape as required by customers. The metal mold high in precision needed for production of the conventional microphone structure leads to the fact that the metal mold inevitably becomes at a markedly high production price and needs a relatively long production period for producing the metal mold and punching and bending a sheet metal. In the case of the metal mold low in precision, on the other hand, unstable electric connections are liable to be caused between the terminal connecters and the board terminals and between the terminal connecters and the condenser microphone when the terminal connecters terminal connecters are assembled with the insulator and the condenser microphone.

SUMMARY OF THE INVENTION

It is, therefore, an object of the present invention to provide a condenser microphone structure which can reduce high frequency noises to as a small level as possible.

It is another object of the present invention to provide a condenser microphone structure which can be produced at a relatively lower production price and at a considerably shorter production period without any metal mold needed to be used for producing terminal connecters forming part of the condenser microphone structure.

It is a further object of the present invention to provide a condenser microphone structure which can realize a stable electrical connection between the elements or parts forming part of the condenser microphone structure.

According to a first aspect of the present invention, there is provided a condenser microphone structure, comprising: a microphone housing formed with an opening; a condenser microphone accommodated in the microphone housing and partly exposed to the exterior through the opening to produce a sound signal indicative of a voice sound after receiving the voice sound through the opening; a pair of terminal connecters consisting of first and second terminal connecters provided on the microphone housing in the neighborhood of each other under an insulated state from each other, each of the first and second terminal connecters including a helical spring portion, and an end portion integrally formed with the helical spring portion, the helical spring portion and the end portion being made of an electrically conductive material, the end portions being electrically connected with the condenser microphone to discharge the sound signal from the condenser microphone through the first and second terminal connecters; and an insulating member accommodated in the microphone housing to retain the condenser microphone and the first and second terminal connecters with the microphone housing and to insulate the first terminal connecter from the second terminal connecter.

According to a second aspect of the present invention, A cellular phone, comprising: a cellular phone housing; a printed circuit board unit including a printed circuit board accommodated in the cellular phone, and first and second board terminals mounted on the printed circuit board in spaced and insulated relationship with each other; a microphone housing formed with an opening; a condenser microphone accommodated in the microphone housing and partly exposed to the exterior through the opening to produce a sound signal indicative of a voice sound after receiving the voice sound through the opening; a pair of terminal connecters consisting of first and second terminal connecters provided on the microphone housing in the neighborhood of each other under an insulated state from each other, each of the first and second terminal connecters including a helical spring portion, and an end portion integrally formed with the helical spring portion, the helical spring portion and the end portion being made of an electrically conductive material, the helical spring portions being held in pressing engagement with the first and second board terminals of the printed circuit board, respectively, to generate a mutual inductance when one of the helical spring portions of the first and second terminal connecters is energized, the end portions being electrically connected with the condenser microphone to discharge the sound signal from the microphone to the first and second board terminals of the printed circuit board though the first and second terminal connecters; and an insulating member accommodated in the microphone housing to retain the condenser microphone and the first and second terminal connecters with the microphone housing and to insulate the first terminal connecter from the second terminal connecter.

The first and second terminal connecters may be each made of a metal wire.

The first and second terminal connecters may be each made of an iron-alloyed wire.

BRIEF DESCRIPTION OF THE DRAWINGS

The features and advantages of the condenser microphone structure according to the present invention will more clearly be understood from the following description taken in conjunction with the accompanying drawings in which.

DESCRIPTION OF THE EMBODIMENTS

One embodiment of the condenser microphone structure according to the present invention will be described hereinafter with reference to the drawings, particularly to FIGS. 1 to 3. Throughout the following detailed description, similar reference numbers refer to respective similar elements in all figures of the drawings.

Figure 1:
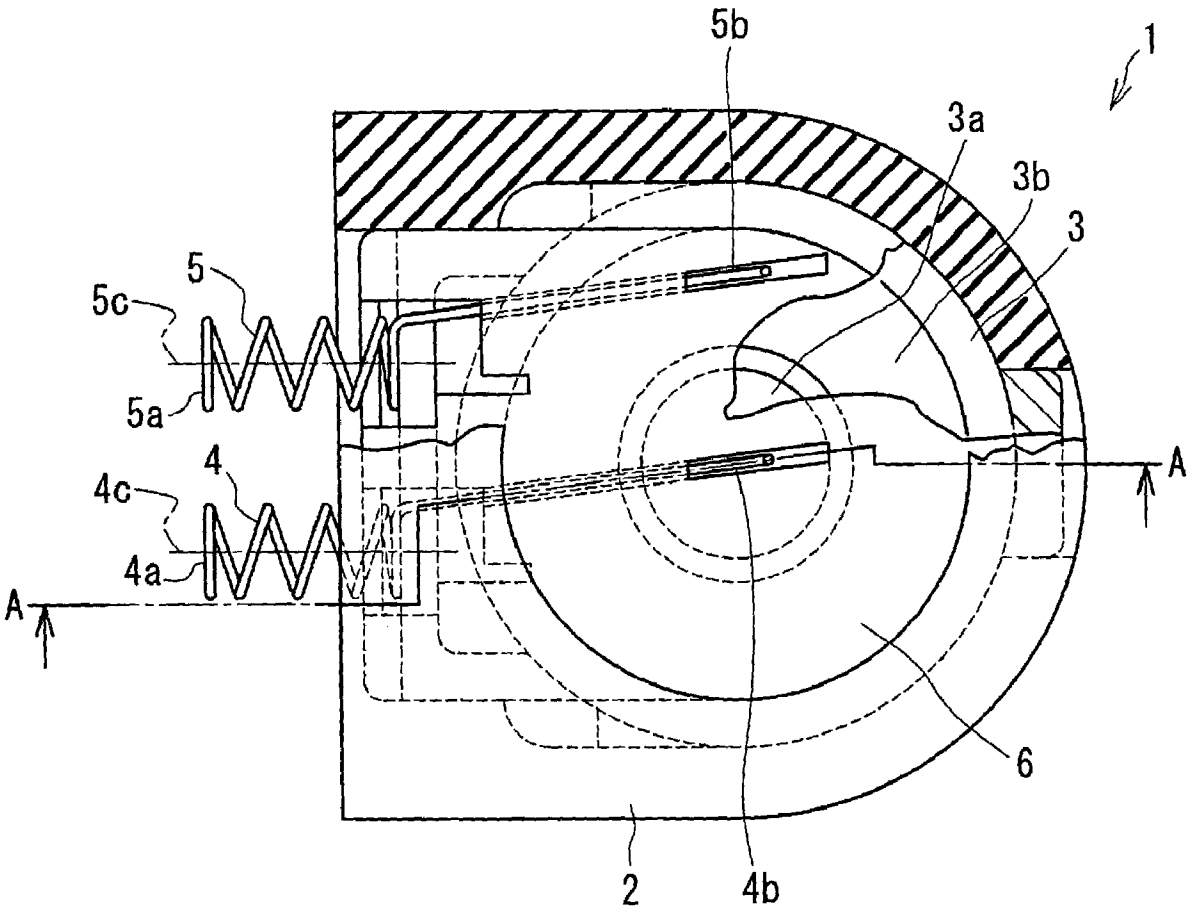
FIG. 1 is a plan view, partially cross section, of the condenser microphone structure according to the present invention.
Figure 2:
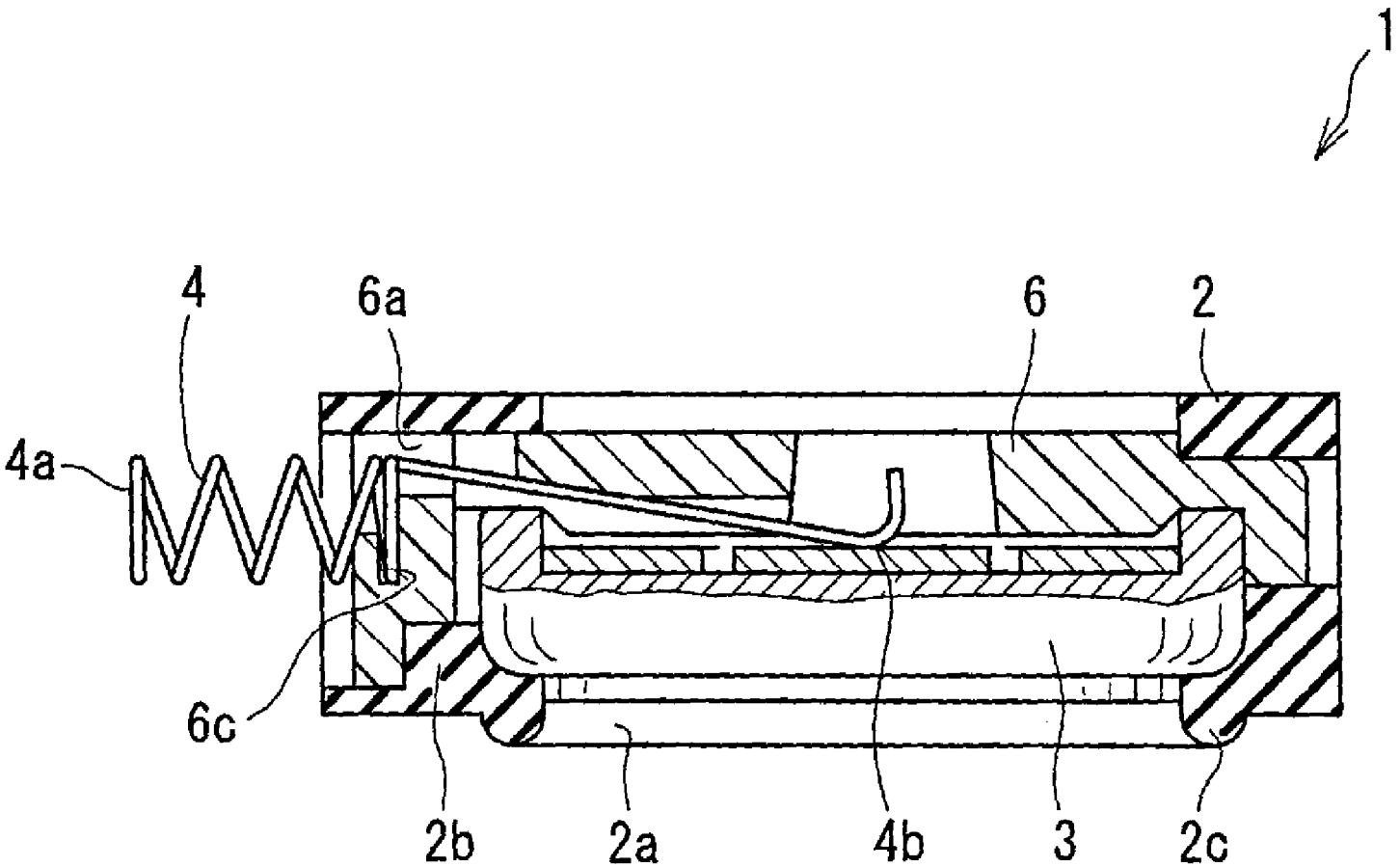
FIG. 2 is a cross-sectional view, taken along the lines A—A in FIG. 1, of the condenser microphone structure according to the present invention.

The embodiment of the condenser microphone structure 1 is shown in FIGS. 1 and 2 as comprising a microphone housing 2 formed with an opening 2*a*, and a condenser microphone 3 accommodated in the microphone housing 2 and partly exposed to the exterior through the opening 2*a* so that the condenser microphone 3 is capable of receiving a voice sound through the opening 2*a* to produce a sound signal indicative of the voice sound. The microphone housing 2 is made of a resilient material such as for example rubber and synthetic resin, and has an open end opened toward a printed circuit board unit 12 which becomes apparent as the description proceeds. The microphone housing 2 further has an inner surface from which is projected a fixing projection 2*b* to be engaged with the outer surface of the condenser microphone 3 so that the condenser microphone 3 is firmly coupled with the microphone housing 2 when the condenser microphone 3 is assembled with the microphone housing 2.

Figure 4:
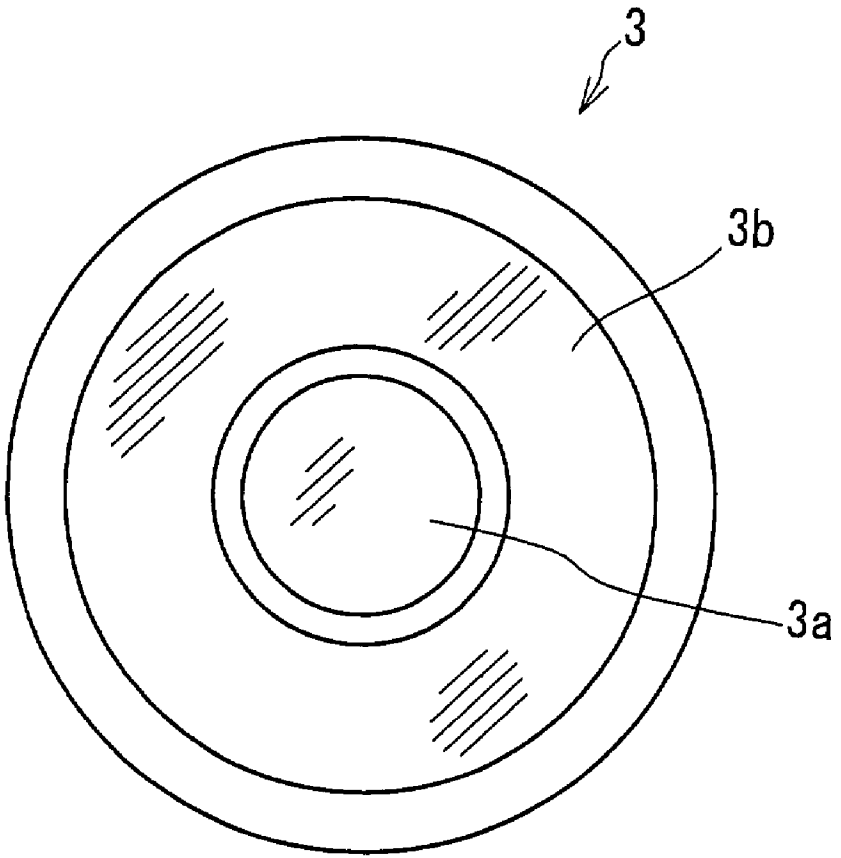
FIG. 4 is a plan view of the condenser microphone forming part of the condenser microphone structure according to the present invention.

As best shown in FIG. 4, the condenser microphone 3 has a pair of annular microphone terminals 3*a* and 3*b* in radially spaced apart from and coaxial relationship with each other to ensure that the annular microphone terminals 3*a* and 3*b* are maintained under an insulated state.

Figure 3:
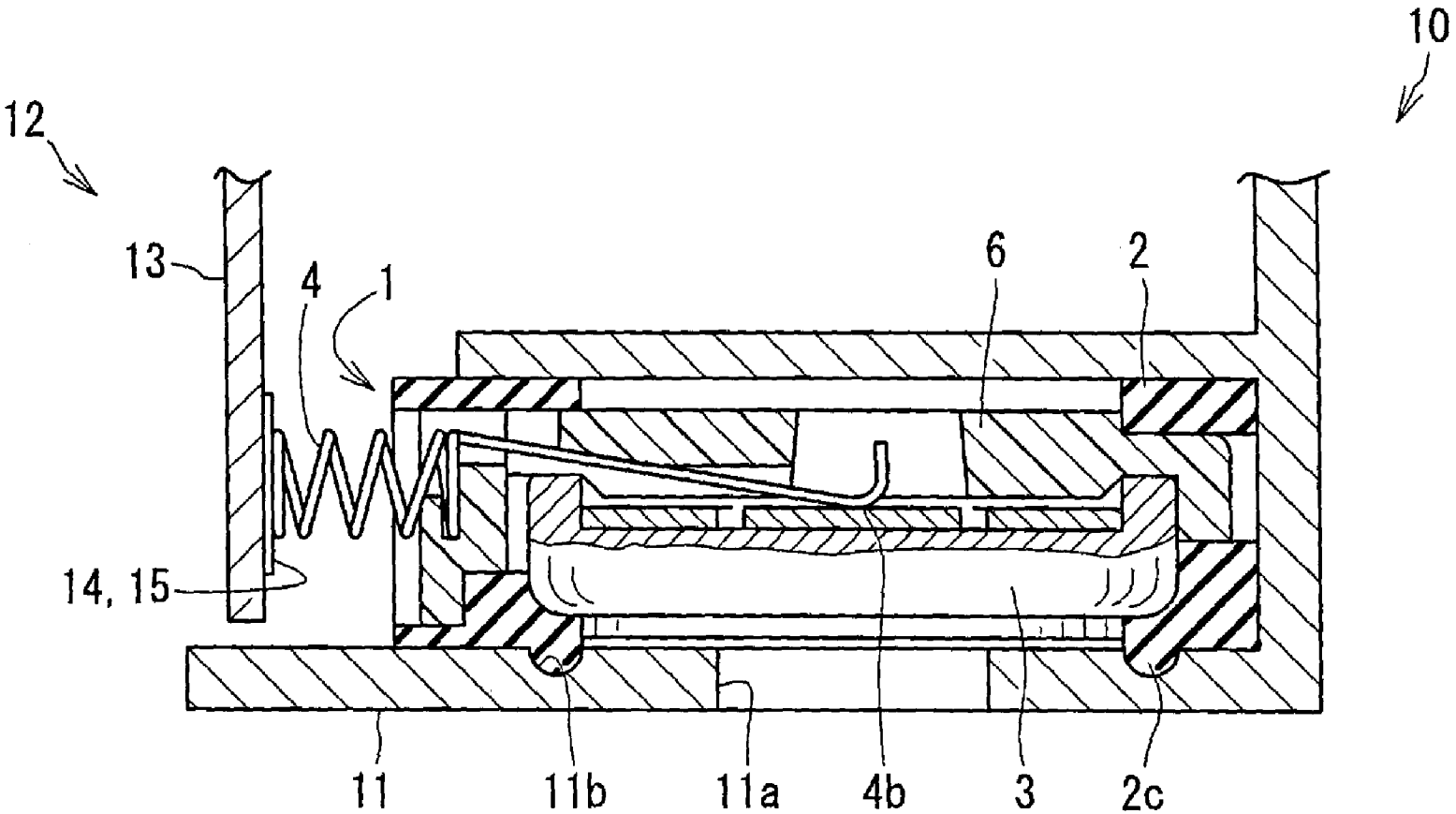
FIG. 3 is a cross-sectional view similar to FIG. 2 but showing part of the cellular phone in combination with the condenser microphone structure according to the present invention.

Turning to FIGS. 1 to 3, the condenser microphone structure 1 further comprises a pair of terminal connecters consisting of first and second terminal connecters 4 and 5 provided on the microphone housing 2 in the neighborhood of and in spaced relation with each other to ensure that the terminal connecters 4 and 5 are maintained under an insulated state. The first terminal connecter 4 includes a helical spring portion 4*a*, and an end portion 4*b* integrally formed with the helical spring portion 4*a*, while the second terminal connecter 5 also includes a helical spring portion 5*a*, and an end portion 5*b* integrally formed with the helical spring portion 5*a*. Here, the term "helical spring portion" is intended to mean a portion in the form of a wire coiled from its one end to the other end to generate a resilient force when being pressurized. The helical spring portions 4*a* and 5*a* of the first and second terminal connecters 4 and 5 have respective center axes 4*c* and 5*c*. The first and second terminal connecters 4 and 5 are assembled with the microphone housing 2 in such a manner that first and second terminal connecters 4 and 5 are arranged with the center axes 4*c* and 5*c* in parallel and spaced relationship with an intermediate space between the first and second terminal connecters 4 and 5, and with the end portions 4*b* and 5*b* electrically connected to the microphone terminals 3*a* and 3*b*, respectively.

The condenser microphone structure 1 is best shown in FIG. 3 as being assembled with a cellular phone 10 which comprises a cellular phone housing 11 formed with an opening 11*a*, and a printed circuit board unit 12 including a printed circuit board 13 accommodated in the cellular phone 10, and first and second board terminals 14 and 15 mounted on the printed circuit board 13 in spaced and insulated relationship with each other. The second board terminal is hidden behind the first board terminal 14 but only bears a reference numeral 15. The cellular phone housing 11 is formed with an annular groove 11*b*, while the microphone housing 2 is formed with an annular protrusion 2*c* encircling the opening 2*a*. The annular protrusion 2*c* of the microphone housing 2 is fittedly received in the annular groove 11*b* of the cellular phone housing 11 with the bottom surface of the microphone housing 2 held in engagement with the inner surface of the cellular phone housing 11 when the condenser microphone 3 and the microphone housing 2 are assembled with the cellular phone housing 11.

Under the state that the condenser microphone 3 and the microphone housing 2 are assembled with the cellular phone housing 11, the helical spring portions 4*a* and 5*a* are held in pressing and resilient engagement with the first and second board terminals 14 and 15, respectively, and the end portions 4*b* and 5*b* are electrically connected with the condenser microphone 3 so that the condenser microphone 3 can discharge the sound signal through the first and second terminal connecters 4 and 5 to the printed circuit board 13 when one of the helical spring portions 4*a* and 5*a* of the first and second terminal connecters 4 and 5 is energized to generate a mutual inductance. Each of the first and second terminal connecters 4 and 5 of the condenser microphone structure 1 is made of an electrically conductive material such as a metal wire which is smaller in surface area than metal plate forming part of the conventional condenser microphone structure. Further, it is preferable that each of the first and second terminal connecters 4 and 5 be made of an iron-alloyed wire. The first and second terminal connecters 4 and 5 made of the iron-alloyed wire ensures a high resistance, thereby make it possible to reduce high frequency noises to a minimum level.

Figure 5:
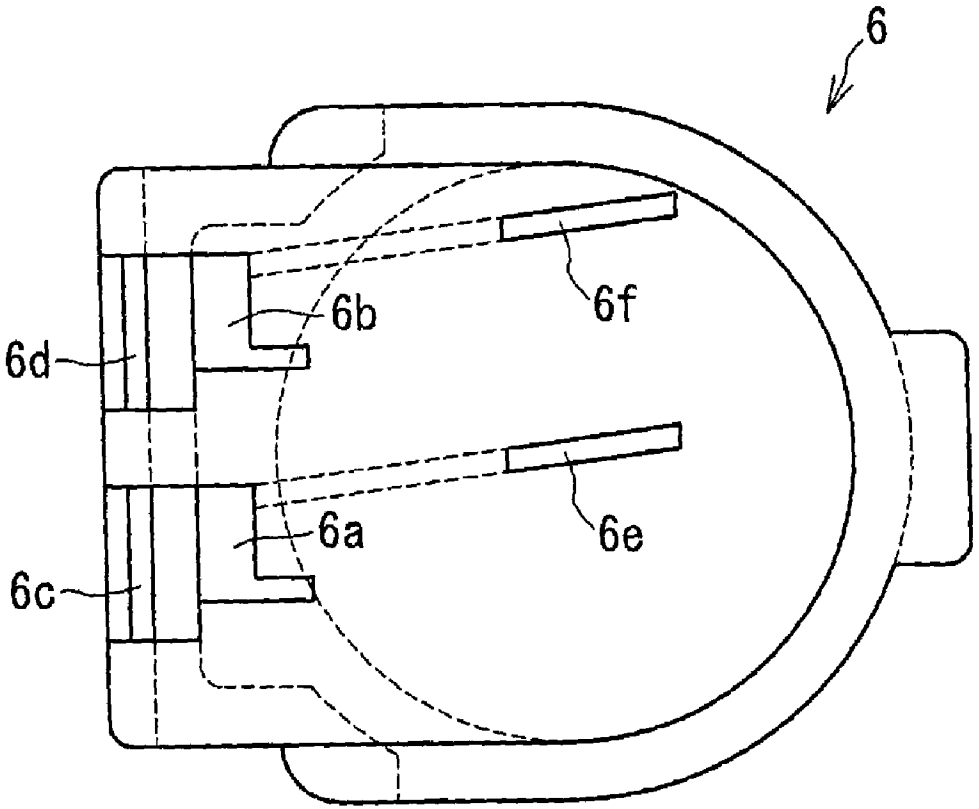
FIG. 5 is a plan view of the insulator member forming part of the condenser microphone structure according to the present invention.

As best shown in FIGS. 2 and 5, the condenser microphone structure 1 further comprises an insulating member 6 accommodated in the microphone housing 2 to retain the condenser microphone 3 and the first and second terminal connecters 4 and 5 with the microphone housing 2 with the first terminal connecter 4 insulated from the second terminal connecter 5. The insulating member 6 is formed with a pair of through bores 6*a* and 6*b* having the terminal connecters 4 and S respectively pass therethrough in the process of producing the condenser microphone structure 1 to be assembled with the cellular phone 10. The insulating member 6 has a pair of retaining grooves 6*c* and 6*d* formed therein in spaced relationship with each other and adjacent to the through bores 6*a* and 6*b* to firmly receive parts of the helical spring portions 4*a* and 5*a* of the first and second terminal connecters 4 and 5, respectively. Further, the insulating member 6 has a pair of rectangular openings 6*e* and 6*f* formed therein in spaced relationship with each other to allow the end portions 4*b* and 5*b* of the terminal connecters 4 and 5 to be respectively loosely received therein but in part electrically connected with the condenser microphone 3.

The following description will hereinafter be directed to a process of producing the condenser microphone structure 1 according to the present invention as described in the above.

Firstly, the microphone housing 2, the condenser microphone 3, the terminal connecters 4 and 5, and the insulating member 6 are prepared.

Figure 6:
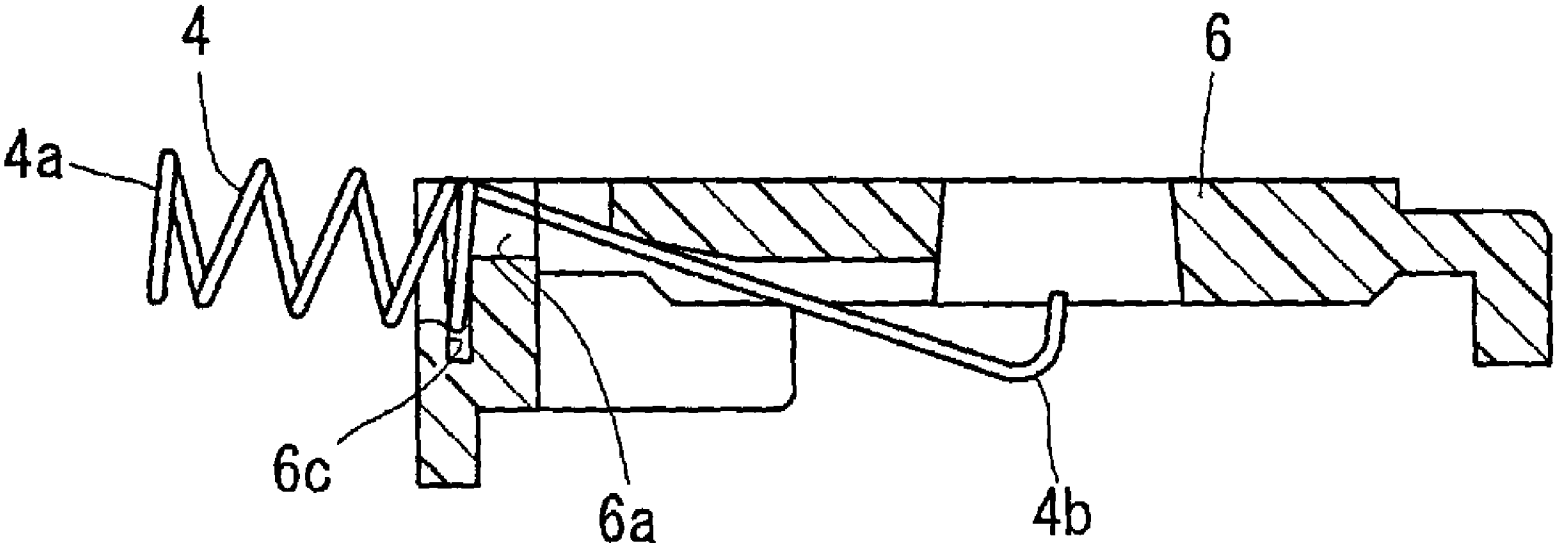
FIG. 6 is an explanatory view showing a step of assembling the insulator member and the terminal connecters.
Figure 7:
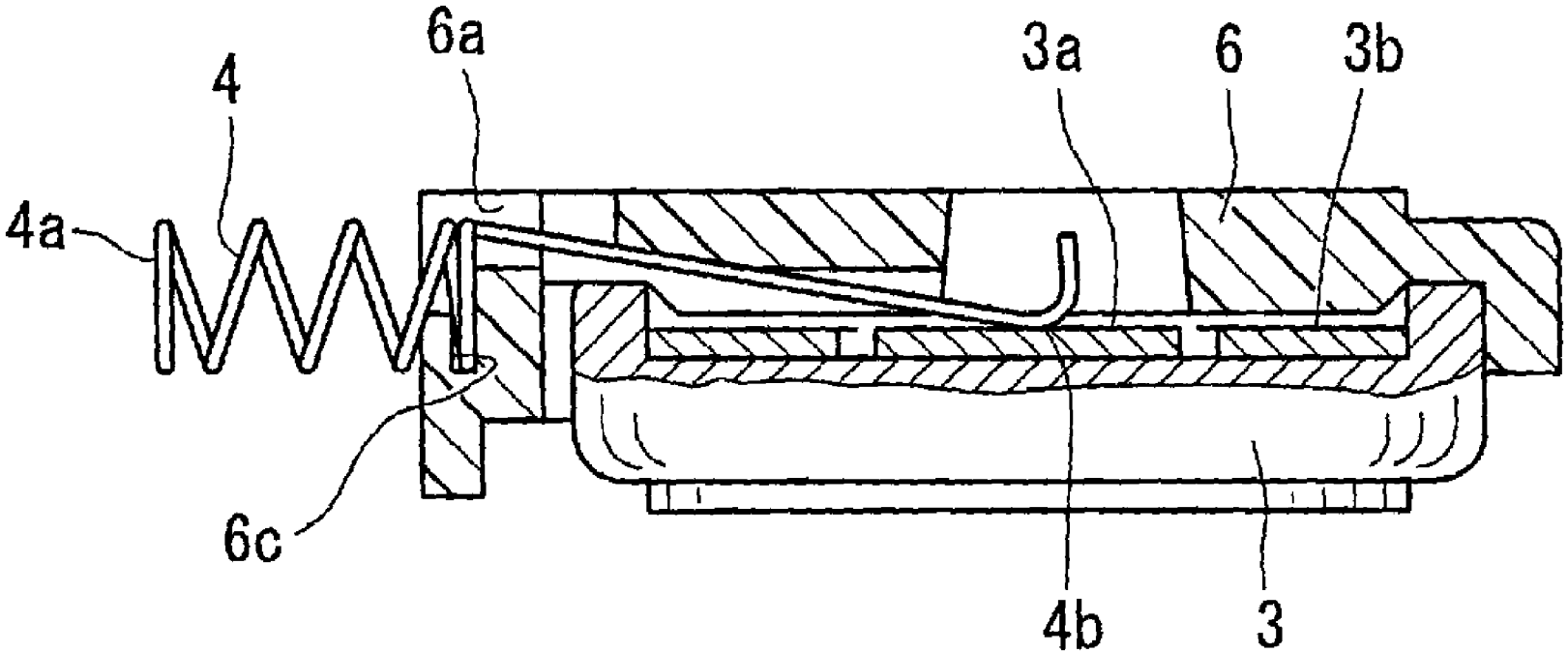
FIG. 7 is an explanatory view showing a step of assembling the insulator member, the terminal connecters, and the condenser microphone.
Figure 8:
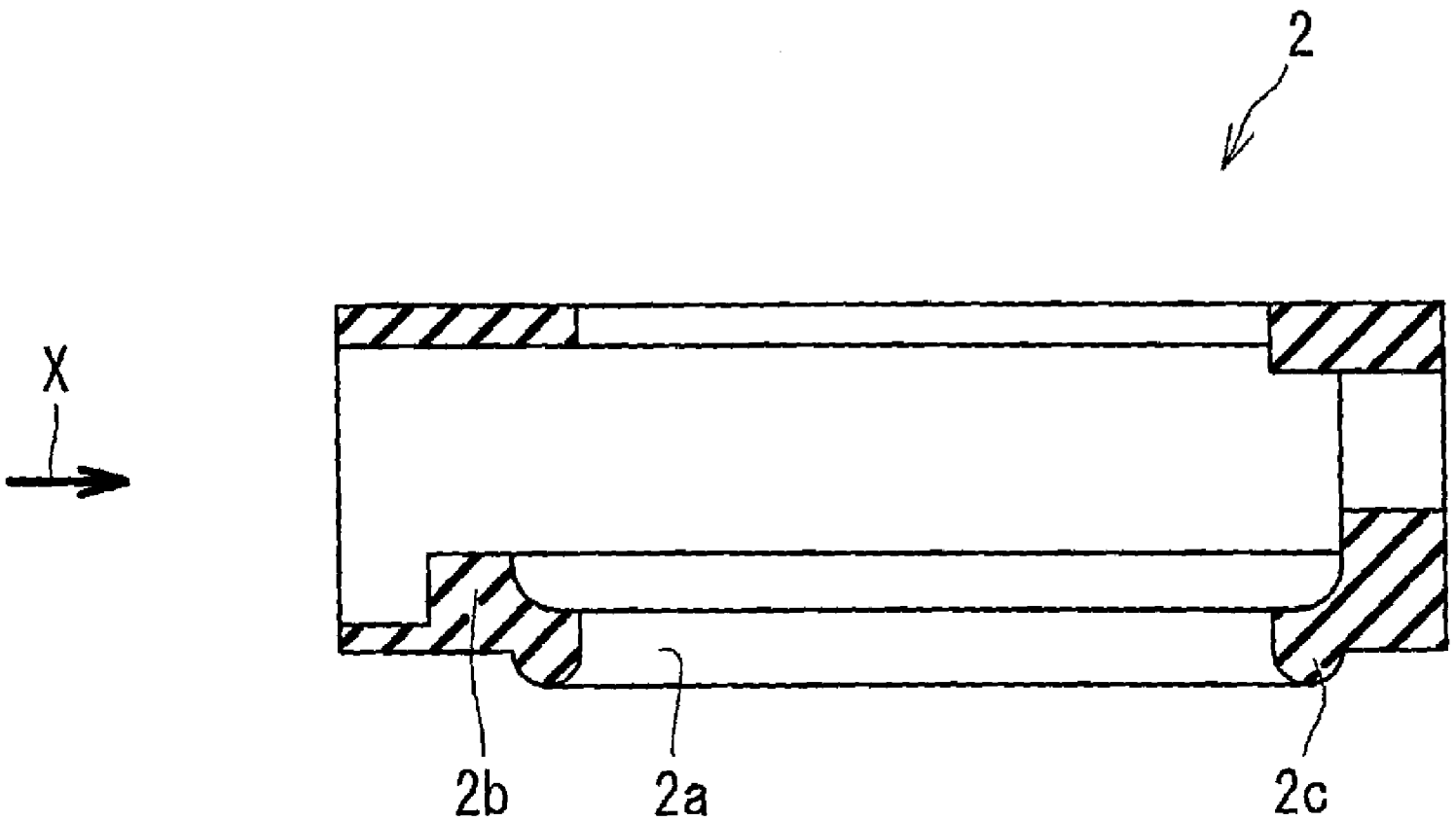
FIG. 8 is an explanatory view showing a step of assembling the insulator member, the terminal connecters, and the condenser microphone with the microphone housing.

The pair of the terminal connecters 4 and 5 are then inserted though the bores 6*a* and 6*b*, respectively, of the insulating member 6 as shown in FIG. 6. The condenser microphone 3 is then coupled with the insulating member 6 as shown in FIG. 7. The condenser microphone 3 and the insulating member 6 coupled with each other are then inserted into and assembled with the microphone housing 2 in a direction indicated by an arrow X as shown in FIG. 8. The microphone housing 2, the condenser microphone 3, and the insulating member 6 thus assembled are finally assembled with the cellular phone housing 11. At this time, the helical spring portions 4*a* and 5*a* of the terminal connecters 4 and 5 are brought into pressing and resilient engagement with the board terminals 14 and 15 of the printed circuit board unit 12, and the end portions 4*b* and 5*b* are electrically connected with the condenser microphone 3 to ensure that the terminal connecters 4 and 5 are electrically connected to the board terminals 14 and 15, respectively, of the printed circuit board unit 12 as shown in FIG. 3. The electric connections between the terminal connecters 4, 5 and the board terminals 14, 15 leads to the fact that the mutual inductance is generated at a relatively high level by the helical spring portions 4*a* and 5*a* of the terminal connecters 4 and 5. The mutual inductance thus generated makes it possible to reduce the high frequency noises level in the condenser microphone structure 1 to a small value as compared with that of the conventional condenser microphone structure. In addition, the helical spring portions 4*a* and 5*a* of the terminal connecters 4 and 5 brought into pressing and resilient engagement with the board terminals 14 and 15 of the printed circuit board unit 12 can bring about a stable electrical connection between the terminal connecters 4 and 5 and the board terminals 14 and 15.

On the other hand, the terminal connecters 4 and 5 are each produced simply by coiling a metal wire around for example a cylindrical rod after cutting the metal wire at a predetermined length, and therefore need neither metal mold nor metal plate to be punched and bent as necessitated in the production of the conventional condenser microphone structure. This makes it possible for the condenser microphone structure 1 is produced at a relatively low production price and at a considerably short production period.

Figure 9:
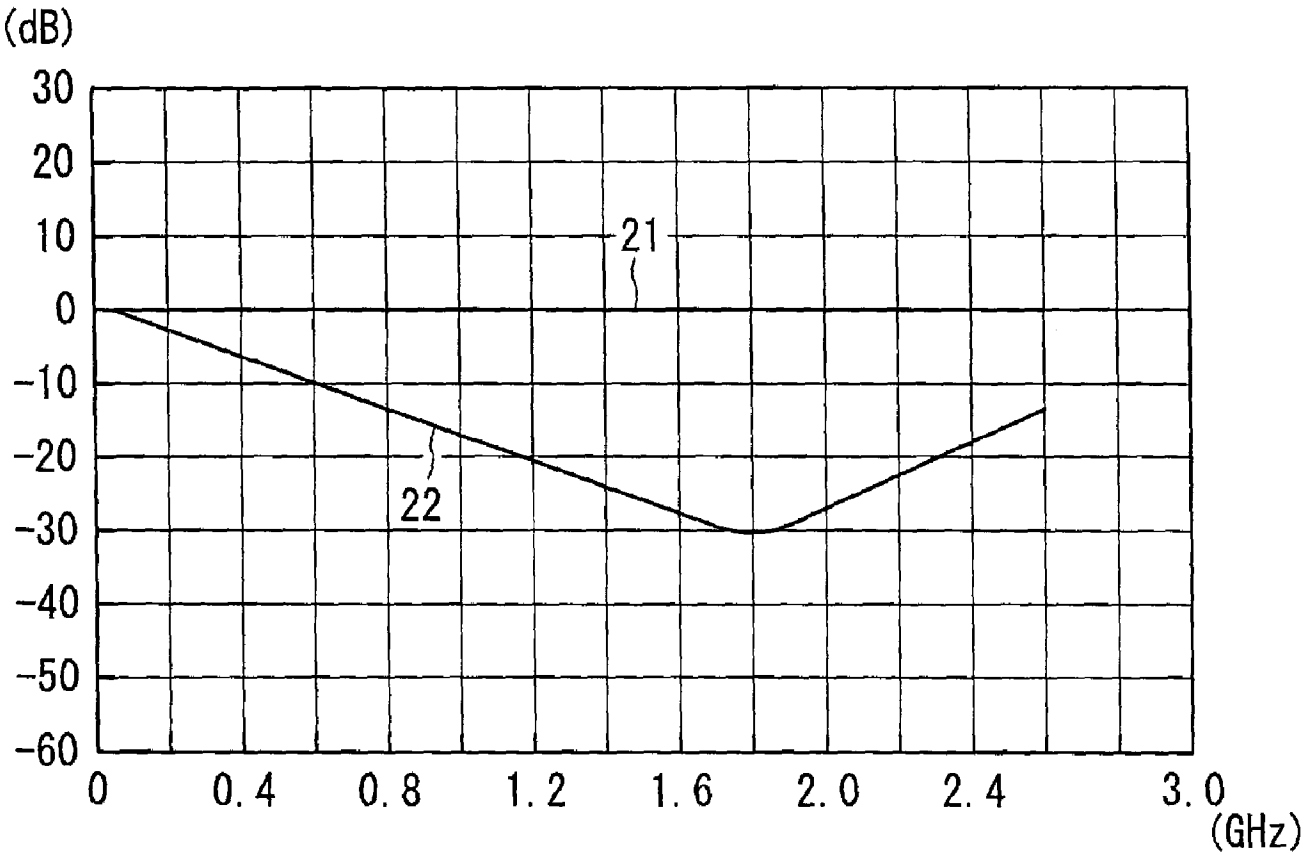
FIG. 9 is a graph showing the high frequency noises characteristics of terminal connecters made of an iron-alloyed wire to be used for production of the condenser microphone structure according to the present invention in comparison with a cupper-alloyed wire used in the conventional condenser microphone structure.
Figure 10:
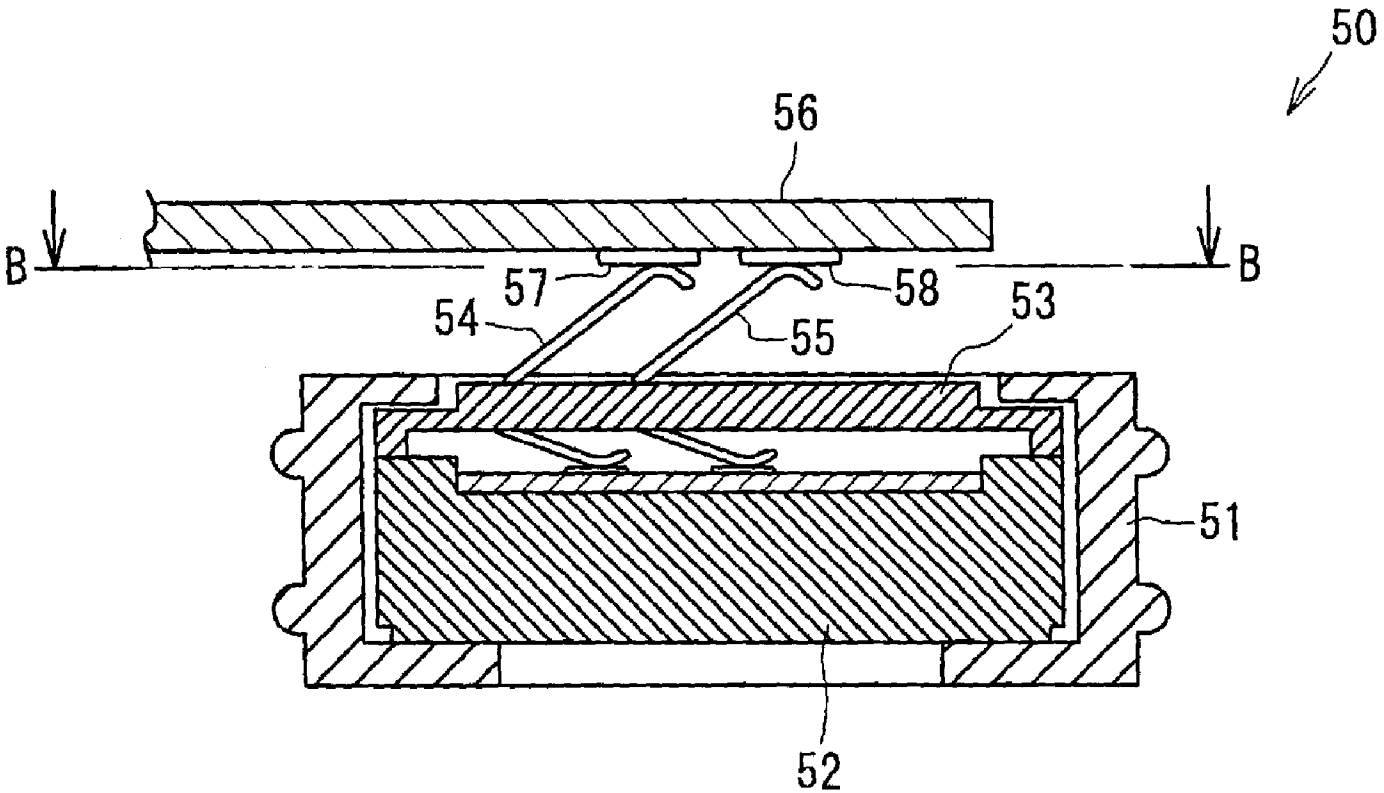
FIG. 10 PRIOR ART
FIG. 10 is a cross-sectional view of the conventional condenser microphone structure.
Figure 11:
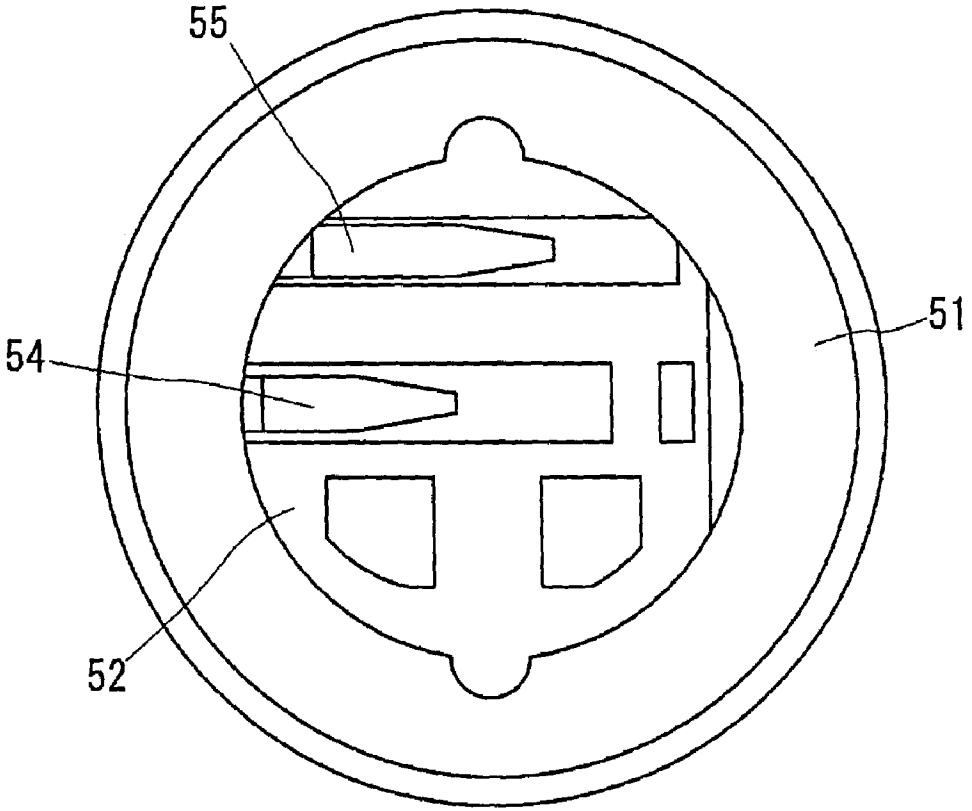
FIG. 11 PRIOR ART
FIG. 11 is a plan view of the conventional condenser microphone structure seen from the lines B—B of FIG. 10.

FIG. 9 is a graph showing the high frequency noises characteristics 22 of terminal connecters 4 and 5 made of an iron-alloyed wire to be used for the condenser microphone structure 1 according to the present invention in comparison with the high frequency noises characteristics 21 of terminal connecters 4 and 5 made of a cupper-alloyed wire to be used for the conventional condenser microphone structure. As will be understood from the graph shown in FIG. 9, the condenser microphone structure 1 according to the present invention is superior to the conventional condenser microphone structure from the fact that the high frequency noises level for the condenser microphone structure 1 according to the present invention is lower than that of the conventional condenser microphone structure. This results from the fact that the condenser microphone structure 1 according to the present invention can be high in mutual inductance level, compared with the conventional condenser microphone structure since the condenser microphone structure 1 according to the present invention is constituted by a pair of terminal connecters 4 and 5 each partly formed with helical spring portions 4*a* and 5*a*, while the conventional condenser microphone structure is formed with a pair of terminal connecters 4 and 5 each made of a metal plate.

As will be understood from the foregoing description, the condenser microphone structure according to the present invention can reduce high frequency noises level to a small value as compared with that of the conventional condenser microphone structure, viz., can cause high frequency noises to be reduced to as a small level as possible. The condenser microphone structure according to the present invention can be produced at a relatively low production price and at a considerably short production period. The condenser microphone structure according to the present invention can realize a stable electrical connection between the terminal connecters and the board terminals.

While the present invention has thus been shown and described with reference to the specific embodiments, however, it should be noted that the invention is not limited to the details of the illustrated structures but changes and modifications may be made without departing from the scope of the appended claims.

What is claimed is:

1. A condenser microphone structure, comprising:

a microphone housing formed with an opening;

a condenser microphone accommodated in said microphone housing and partly exposed to the exterior through said opening to produce a sound signal indicative of a voice sound after receiving the voice sound through said opening, said condenser microphone having a pair of annular microphone terminals in radially spaced apart from and coaxial relationship with each other;

a pair of terminal connecters consisting of first and second terminal connecters provided on said microphone housing in the neighborhood of each other under an insulated state from each other, each of said first and second terminal connecters including a helical spring portion, and an end portion integrally formed with said helical spring portion, said helical spring portion and said end portion being made of an electrically conductive material, said end portions being in contact with said microphone terminals, respectively, to ensure that said end portions are electrically connected with said condenser microphone to discharge said sound signal from said condenser microphone through said first and second terminal connecters, said helical spring portions extending externally from said condenser microphone, and having respective center axes in parallel relationship with said microphone terminals; and an insulating member accommodated in said microphone housing to retain said condenser microphone and said first and second terminal connecters with said microphone housing and to insulate said first terminal connecter from said second terminal connecter.

2. A condenser microphone structure as set forth in claim 1, in which said first and second terminal connecters are each made of a metal wire.

3. A condenser microphone structure as set forth in claim 1, in which said first and second terminal connecters are each made of an iron-alloyed wire.

4. A condenser microphone structure as set forth in claim 1, in which said insulating member has a pair of retaining grooves formed thereon in spaced relationship with each other to firmly receive parts of said helical spring portions of said first and second terminal connecters, respectively.

5. A condenser microphone structure as set forth in claim 1, in which said condenser microphone has an outer surface, and said microphone housing has an inner surface on which is formed a fixing projection to be engaged with said outer surface of said condenser microphone when said condenser microphone and said insulating member are assembled with said microphone housing.

6. A condenser microphone structure as set forth in claim 1, in which said first and second terminal connecters are in spaced relationship with each other with an intermediate space between said first and second terminal connecters to ensure a mutual inductance generated when one of said helical spring portions of said first and second terminal connecters is energized.

7. A condenser microphone structure as set forth in claim 1, in which said helical spring portions of said first and second terminal connecters have respective center axes, said first and second terminal connecters being arranged with said center axes in parallel and spaced relationship with each other to ensure a mutual inductance generated when one of said helical spring portions of said first and second terminal connecters is energized.

8. A cellular phone, comprising:

a cellular phone housing;

a printed circuit board unit including a printed circuit board accommodated in said cellular phone, and first and second board terminals and mounted on said printed circuit board in spaced and insulated relationship with each other;

a microphone housing formed with an opening;

a condenser microphone accommodated in said microphone housing and partly exposed to the exterior through said opening to produce a sound signal indicative of a voice sound after receiving the voice sound through said opening, said condenser microphone having a pair of annular microphone terminals in radially spaced apart from and coaxial relationship with each other;

a pair of terminal connecters consisting of first and second terminal connecters provided on said microphone housing in the neighborhood of each other under an insulated state from each other, each of said first and second terminal connecters including a helical spring portion, and an end portion integrally formed with said helical spring portion, said helical spring portion and said end portion being made of an electrically conductive material, said helical spring portions being held in pressing engagement with said first and second board terminals, respectively, said end portions being in contact with said microphone terminals, respectively, to ensure that said end portions are electrically connected with said condenser microphone to discharge said sound signal from said microphone to said printed circuit board through said first and second terminal connecters and said first and second board terminals, said helical spring portions extending externally from said condenser microphone, and having respective center axes in parallel relationship with said microphone terminals; and an insulating member accommodated in said microphone housing to retain said condenser microphone and said first and second terminal connecters with said microphone housing and to insulate said first terminal connecter from said second terminal connecter.

* * * * *